US007775250B2

(12) United States Patent
Filipiak, Jr. et al.

(10) Patent No.: US 7,775,250 B2
(45) Date of Patent: Aug. 17, 2010

(54) SOFT VERTICAL END PANEL ARRANGEMENT FOR A WINDOW BLIND

(75) Inventors: Thomas Paul Filipiak, Jr., Fort Atkinson, WI (US); Gerald Alfred Moisan, Madison, WI (US)

(73) Assignee: Springs Window Fashions, LLC, Middleton, WI (US)

( * ) Notice: Subject to any disclaimer, the term of this patent is extended or adjusted under 35 U.S.C. 154(b) by 255 days.

(21) Appl. No.: 11/875,143

(22) Filed: Oct. 19, 2007

(65) Prior Publication Data

US 2008/0099164 A1 May 1, 2008

Related U.S. Application Data

(60) Provisional application No. 60/863,615, filed on Oct. 31, 2006.

(51) Int. Cl.
*E06B 3/32* (2006.01)

(52) U.S. Cl. ..... 160/89; 160/168.1 V; 160/348; 160/84.01

(58) Field of Classification Search ..... 160/89, 160/168.1 V, 176.1 V, 178.1 V, 348; 16/87.2
See application file for complete search history.

(56) References Cited

U.S. PATENT DOCUMENTS

| | | | | |
|---|---|---|---|---|
| 5,626,177 | A | 5/1997 | Colson et al. | 160/168.1 |
| 5,819,833 | A | 10/1998 | Swiszcz et al. | 160/168.1 |
| 6,076,588 | A | 6/2000 | Swiszcz et al. | 160/168.1 |
| 6,186,213 | B1 | 2/2001 | Senesac | 160/89 |
| 6,334,477 | B1 | 1/2002 | Moir | 160/168.1 |
| 6,491,085 | B1 | 12/2002 | Anthony et al. | 160/168.1 |
| 7,165,594 | B2 * | 1/2007 | Senesac et al. | 160/89 |
| 2003/0102090 | A1 * | 6/2003 | Marocco | 160/89 |
| 2006/0151130 | A1 * | 7/2006 | Ulatowski | 160/168.1 V |

* cited by examiner

*Primary Examiner*—Blair M. Johnson
(74) *Attorney, Agent, or Firm*—Taylor IP, P.C.

(57) ABSTRACT

An end stem for a soft vertical blind includes an arm spaced from an end louver of the blind, and a fabric panel connected to the arm and the end louver forms a column surrounding the end louver.

16 Claims, 6 Drawing Sheets

SOFT VERTICAL END PANEL ARRANGEMENT FOR A WINDOW BLIND

CROSS REFERENCE TO RELATED APPLICATIONS

This non-provisional application is based on and claims all of the benefits of U.S. Provisional Application for Patent Ser. No. 60/863,615, entitled "SOFT VERTICAL END PANEL ARRANGEMENT FOR A WINDOW BLIND", filed Oct. 31, 2006, which is incorporated herein by reference.

BACKGROUND OF THE INVENTION

1. Field of the Invention

The present invention relates to blinds, coverings or treatments for windows and other architectural openings, and, more particularly to window blinds referred to as "soft-vertical" blinds, coverings or treatments having a fabric panel interlaced with vertical slats or louvers.

2. Description of the Related Art

Many different types of treatments are used as coverings for windows, doors and the like for both functional and aesthetic purposes. Functionally, window blinds are used for many purposes, such as to control the amount of light that enters through a window and to provide privacy by obscuring visibility through the window. Accordingly, depending on the nature and construction of the blind, various components of the blind are known to be raised or lowered, moved from side to side or rotated about axis thereof to control the manner in which the window is blocked or exposed to increase or decrease the light passing there through or the visibility through the window. The texture, color and structure of the blind can enhance the décor of a room. Blinds can be mounted in various ways to cover the entire window, window frame and trim; or to cover the window while leaving the window trim exposed. Each provides a different appearance within an overall room design.

Window blinds are provided in many different types, including suspended assemblies of rigid slats of a variety of materials, cloth panels of various types, and combinations of slats and cloth panels. Window blinds often are referred to as "vertical" or "horizontal" blinds, depending on the general orientation and design. For example, a horizontal blind might have a series of horizontal slats suspended from a headrail and a vertical blind might have vertical slats suspended from the headrail.

So-called "soft-vertical" blinds include a plurality of discrete vertical louvers and a panel or panels of fabric attached to and interlaced with the louvers to provide the appearance of fabric and the privacy of slats or louvers. The vertical louvers rotate about longitudinal axis between opened and closed positions. In the closed position, each louver is substantially parallel to the window or door on which the blind is installed, and adjacent edges of adjacent louvers overlap or meet in a closely spaced arrangement to effectively block light and provide privacy. In the opened position of the louvers, each louver is substantially perpendicular to the window, creating an open space or void between adjacent louvers. Intermediate positions between the closed and opened positions also can be used. The fabric panels cover the voids that are created between the opened louvers. It is known further to hang the louvers from carriages that slide along a headrail, so that the louvers with fabric attached thereto can be retracted to uncover completely a portion of, or the entire window.

An undesirable presentation can occur when a soft-vertical blind of the type described is installed in a so-called "inside mount" situation. In an inside mount, the blind is mounted within the window frame, and edges of the blind are closely aligned with the edges of the windowpane. An undesirable presentation can occur when the blind is extended and the louvers rotated to an opened position. As the outer most louvers are rotated with the fabric panel or panels attached thereto, edges of the fabric panels can be rotated toward the center of the blind, exposing window areas along the side edges of the fabric. In that adjusted condition, the fabric covers the areas of the window that are exposed between adjacent louvers. However, a vertical strip of the window outwardly of the outermost louvers along each side can be exposed without covering by the fabric material. The bright bands of exposed window along the sides of the blind can be unpleasing and objectionable.

SUMMARY OF THE INVENTION

The present invention provides improved structure for the outermost louvers at each side of a soft vertical blind, including additional sites at which the cloth panel is attached so that rotation of the louvers does not result in adjustment of an outermost edge of the fabric panel toward the center of the blind.

The invention in one form is directed to a covering for an architectural opening with a head rail; a plurality of louver stems carried by and movable along the head rail and a plurality of louvers connected to and carried by the louver stems. A fabric panel is interlaced with and connected to the louvers. An end stem carried by the head rail includes an end louver-receiving fixture and an arm having a distal end spaced from the end louver-receiving fixture. An end louver connected to and carried by the end stem is in spaced relation to the distal end of the arm. An edge portion of the fabric panel is connected to the end louver and to the distal end of the arm.

The invention in another form is directed to an end stem for a vertical blind having a plurality of louvers and a fabric panel interlaced with and connected to the louvers. The end stem has first and second legs extending from a base area at which the legs are joined. The legs define a slot therebetween for retaining an end louver. An arm having a distal end spaced outwardly from the slot defines a connecting site near a distal end thereof for attachment to the fabric panel.

The invention in still another form is directed to a blind for an architectural opening. The blind has a head rail and a plurality of louvers suspended from the head rail. The plurality of louvers includes an end louver. A fabric panel is connected to the louvers at spaced intervals along the panel, and an edge portion of the fabric panel is connected to the end louver at first and second spaced locations. The edge portion of the panel forms a column substantially encircling the end louver.

An advantage of the present invention is providing an aesthetically pleasing blind having a defined edge that eliminates exposure problems when the angle of the slats is changed.

Another advantage of the present invention is providing a soft vertical blind for windows, doors and the like that effectively covers the side edges of the opening on which it is installed even as the louvers of the blind are rotated between closed and opened positions.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
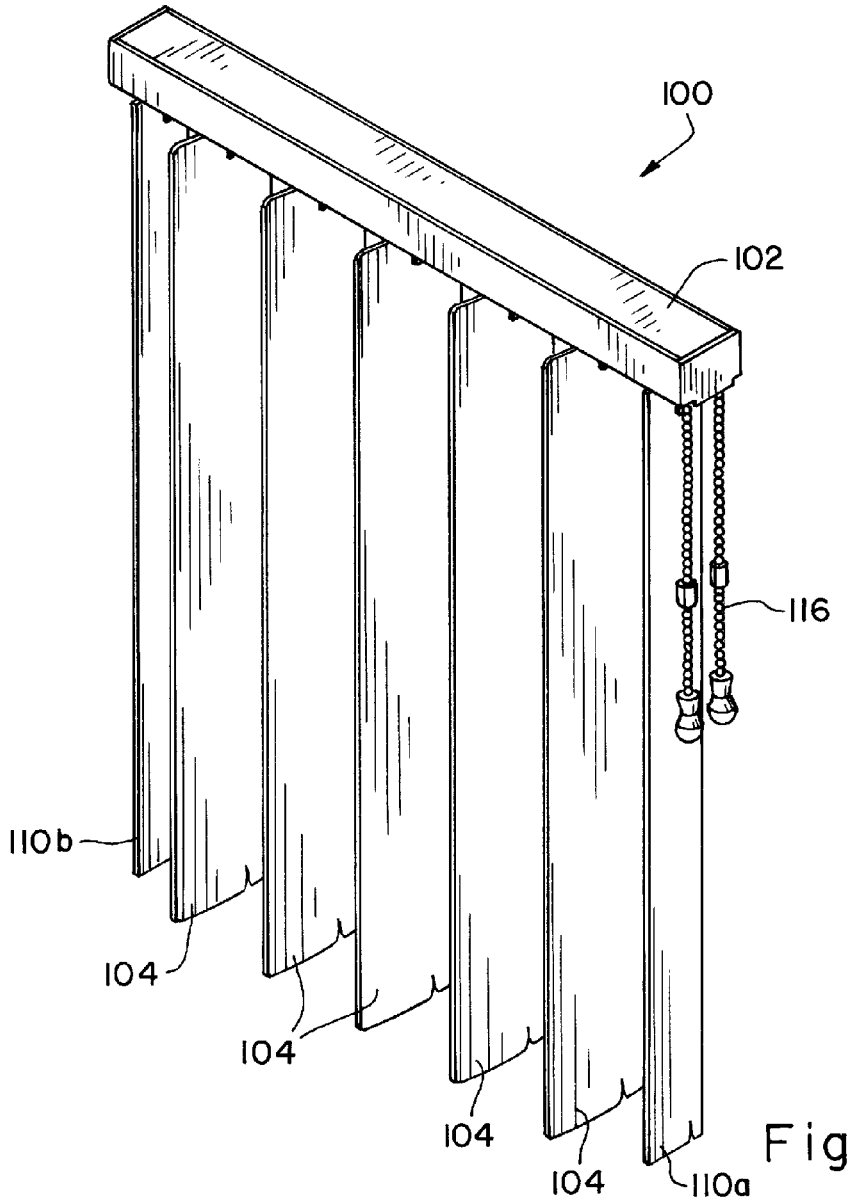
FIG. 1 is a perspective view of a blind in accordance with the present invention, without the fabric panel installed thereon.
Figure 3:
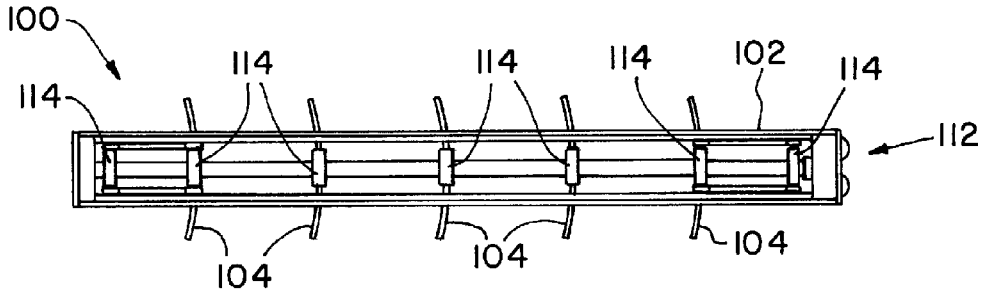
FIG. 3 is a plan view of the top of the blind shown in FIGS. 1 and 2.
Figure 4:
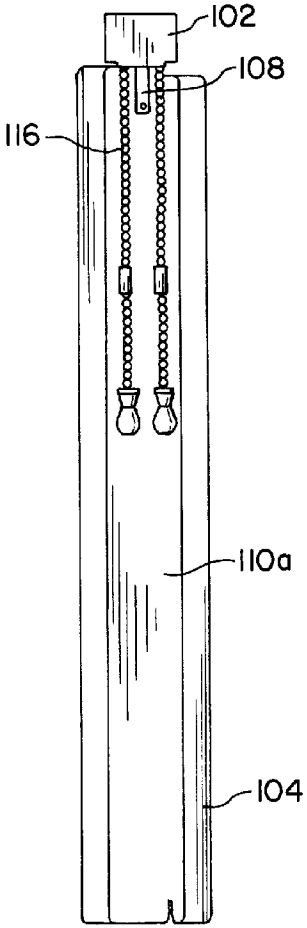
FIG. 4 is an end elevation view of the blind shown in FIGS. 1-3.

Referring now more specifically to the drawings, a window blind 100 of the present invention includes a headrail 102 and a plurality of vertical louvers 104 suspended from louver stems 106 carried in headrail 102. An end stem 108 and an end louver 110 suspended from the end stem are provided at each end of blind 100. In the exemplary embodiment, end louvers 110 at opposite ends are mirror images of each other, and have been designated with reference numeral 110*a* and 110*b* in the drawings. The use and installation thereof together with end stems 108 are similar for each. Accordingly, the descriptions to follow are equally applicable to end louver 110*a* and end louver 110*b*. For clarity in the following descriptions, the end louvers 110*a* and 110*b* are collectively and individually referred to as "end louvers 110" and "end louver 110" respectively.

A drive system 112 is provided in headrail 102 whereby louver stems 106 and end stems 108 can be rotated to adjust louvers 104, 110 between positions substantially parallel to a window on which blind 100 is installed, and a position substantially perpendicular to the window. Further, stems 106 and 108 can be moved along headrail 102 toward and away from one or the other end of blind 100. Accordingly, drive system 112 includes a plurality of carriages 114 to which louver stems 106 and end stems 108 are connected. Carriages 114 are adapted to traverse along head rail 102 while carrying louver stems 106 and end stems 108 therewith, and to rotate louver stems 106 and end stems 108 about substantially vertical axes. Chains 116 or other operating mechanisms not shown, such as traversing cords, rods or wands and the like can be used for operating carriages 114 to rotate the stems, and or for moving the carriages along the headrail. Suitable drive systems 112 and operating mechanisms therefore are well-known to those skilled in the art and will not be described in further detail herein. The present invention can be used with a variety of different drive systems and operating mechanisms therefore.

Figure 6:
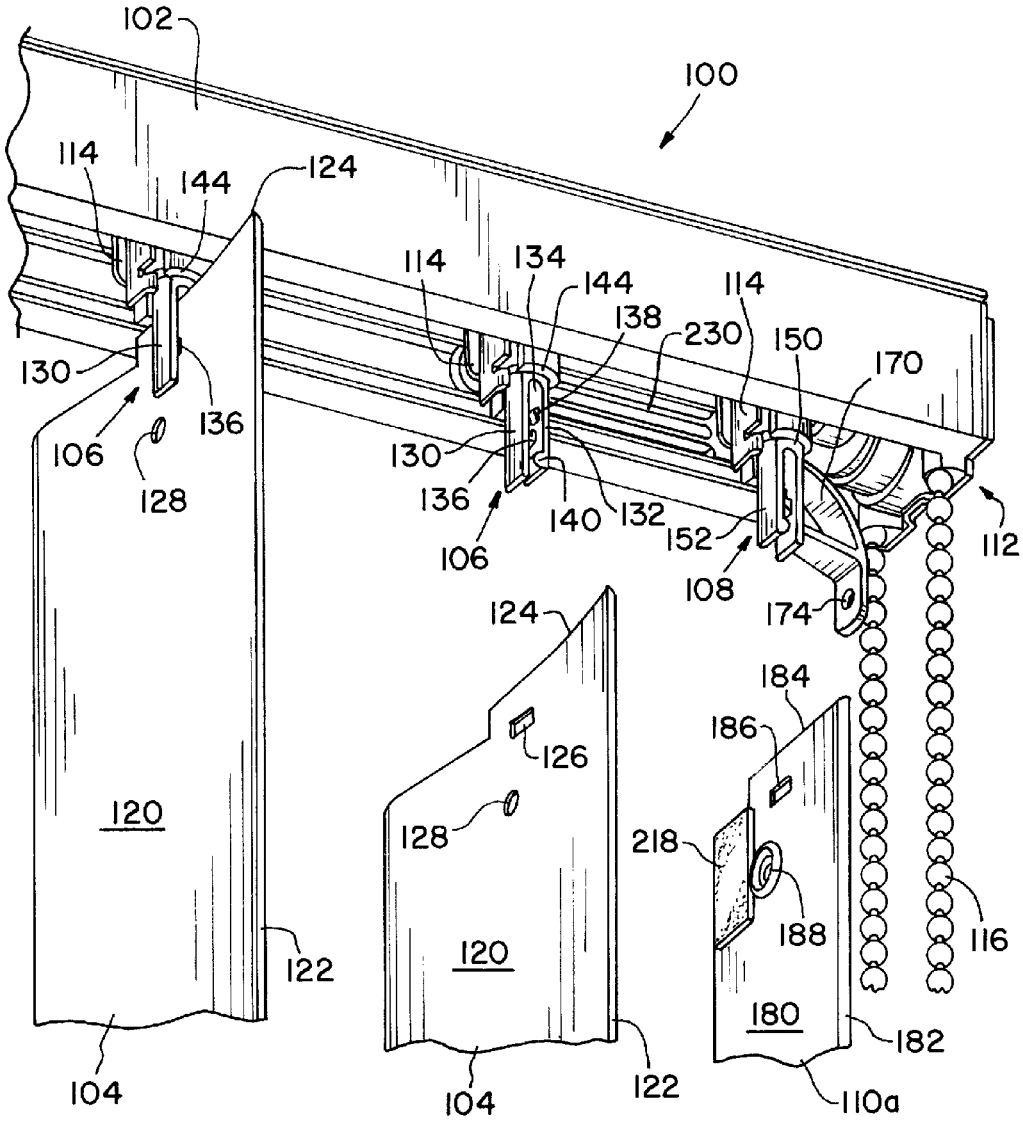
FIG. 6 is a fragmentary perspective view illustrating the installation of louvers in a blind of the present invention.

With reference now more particularly to FIG. 6, louvers 104 are relatively thin, elongate bodies that may be curved for improved rigidity. Louvers 104 have a first face 120 on one side thereof and a second face 122 on an opposite side thereof, and along an upper edge 124 thereof define holes 126 and 128 extending there through from first face 122 to second face 124 for engaging, respectively, louver stem 106 and a fabric panel to be described hereinafter.

Louver stems 106 include legs 130, 132 extending from a joined base thereof and defining an open-ended slot 134 there between for receiving a louver 104. Leg 130 defines a hooked protrusion 136 extending into slot 134, with the hook thereof facing away from the open entrance end of slot 134 to capture louver 104 by engaging hole 126. Leg 132 defines biasing protrusions 138 and 140 to urge louver 104 toward leg 130, securing hole 126 on hooked protrusion 136. The base area of louver stem 106 defines a gear or other driving engagement (not shown) and a collar 144 for association with drive system 112 in head rail 102 whereby louver stem 106 is held in and operated by a carriage 114 in drive system 112. Headrail 102, louvers 104, louver stems 106 and drive system 112 can be of known design, and therefore will not be described in greater detail herein.

Figure 7:
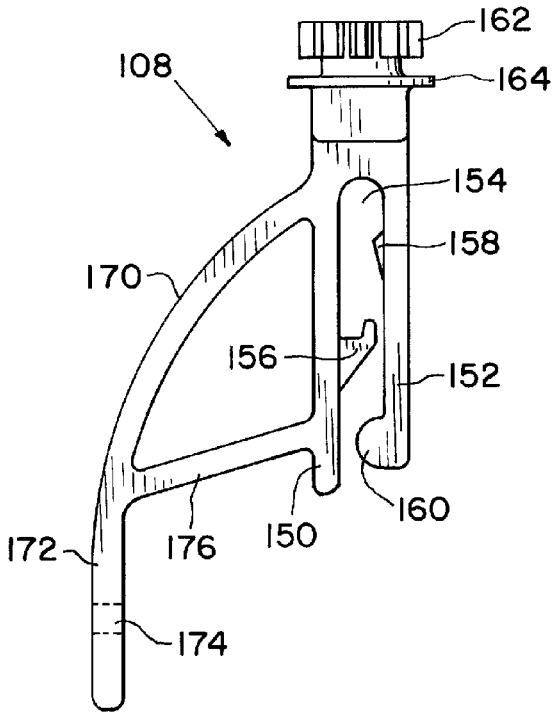
FIG. 7 is a plan view of an end stem for the blind shown in the previous drawings.
Figure 8:
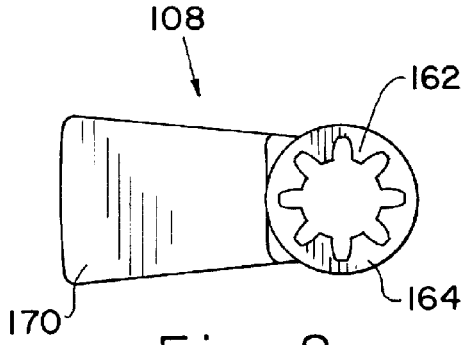
FIG. 8 is a top view of the stem shown in FIG. 7.

End stems 108 of the present invention can be seen best in FIGS. 6, 7 and 8. End stem 108 includes an end louver-receiving fixture formed by legs 150, 152 extending from a joined base thereof similar to legs 130, 132 described with respect to louver stems 106. Legs 150, 152 define an open-end slot 154 there between for receiving end louver 110. Leg 150 defines a hooked protrusion 156 extending into slot 154, with the hook thereof facing away from the open entrance end of slot 154. Leg 152 defines biasing protrusions 158 and 160 to urge an end louver 110 held thereby toward leg 150. The base area of end stem 108 further defines a gear 162 and collar 164 similar to gear and collar 144 for association with drive system 112 in head rail 102 whereby end stem 108 is held in and operated by a carriage 114 in drive system 112.

End stem 108 further includes a curved arm 170 having a distal end portion 172 defining a hole 174. Hole 174 is a connecting site for attachment of a fabric panel to be described. A brace 176 provides rigidity between leg 150 and arm 170.

Figure 2:
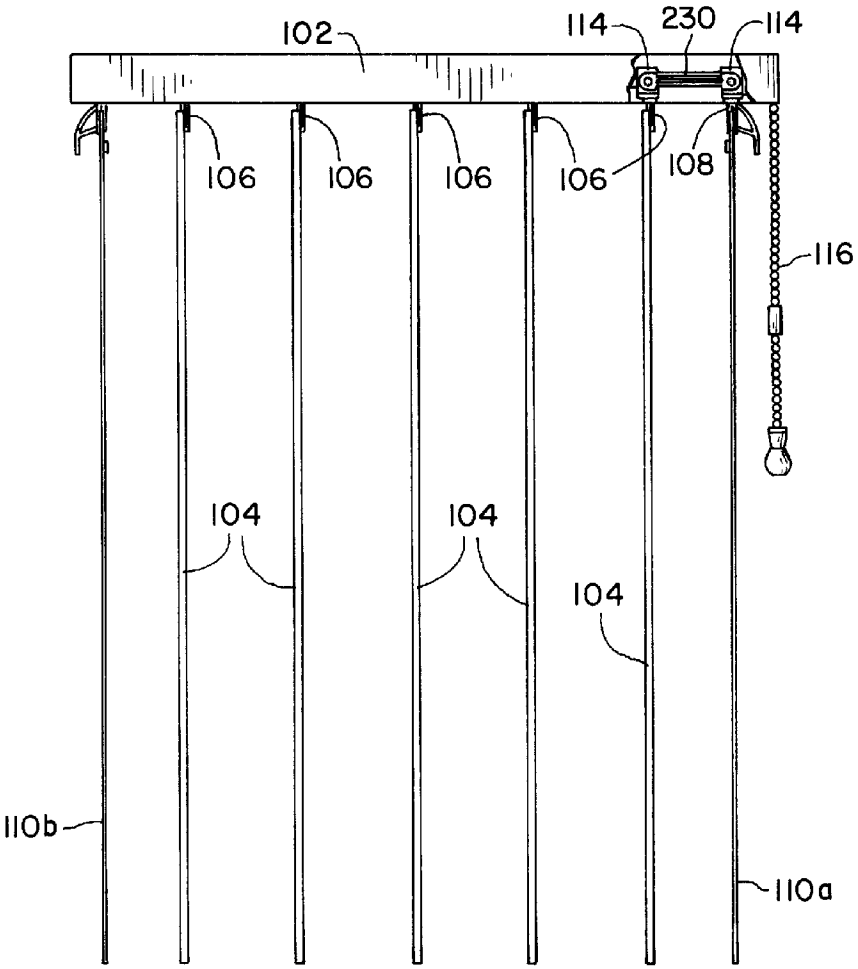
FIG. 2 is an elevation view of the blind shown in FIG. 1.
Figure 5:
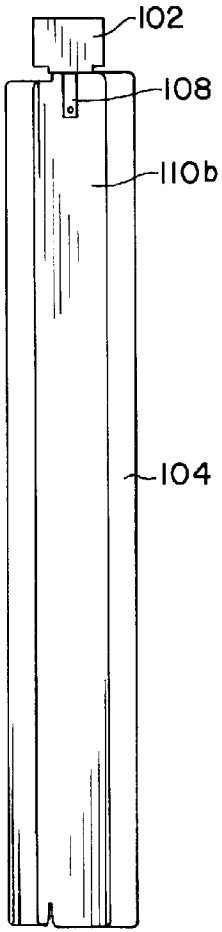
FIG. 5 is an end elevation view of the blind shown in the preceding views, illustrating the end opposite the end shown in FIG. 4.

Arm 170 extends outwardly and downwardly from near a top of end stem 108, near the joined base area of legs 150, 152. Arm 170 is positioned with respect to legs 150, 152; slot 154, and end louver 110 such that when louvers 104 and 110 are rotated to the closed position, arm 170 is positioned either on the window side or the room side of the outermost vertical louver 110 held thereby. Blinds 100 of the present invention can be assembled so that when the louvers are closed both end stems 108 are on either the window side or the room side of the outermost vertical louvers 110. Alternatively, blinds 100 of the present invention can be assembled so that when the louvers are closed one end stem 108 is on the window side of the outermost louver 110 held thereby and the other end stem 108 is on the room side of the outermost vertical louver 110 held by it. For any of the aforedescribed arrangements, as the stems 106, 108 and louvers 104, 110 suspended there from rotate to the opened positions, arm 170 is rotated with end stem 108 to an outward or lateral position relative to end stem 108 (FIGS. 2 & 6). Arm 170 defines the lateral edge of the blind when the louvers are rotated to the opened positions, and arm 170 is in the outward position.

End louvers 110 carried in the two end stems 108 are of reduced width in comparison to the widths of louvers 104 carried in the louver stems 106 between the two outside or end stems 108. End louvers 110 are relatively thin, elongate bodies that may be curved for improved rigidity. End louvers 110 have a first face 180 on one side thereof and a second face 182 on a second side thereof, and along an upper edge 184 thereof define holes 186 and 188 extending there through from first face 180 to second face 182 for engaging, respectively, end stem 108 and a fabric panel to be described hereinafter. Hole 186 is engaged upon hooked protrusion 156, and held thereon via the biasing influence of biasing protrusions 158 and 160. Hole 188 defines a connecting site at which a fabric panel is attached. Accordingly, the manner in which end louvers 110 are carried in end stems 108 is similar to the manner in which louvers 104 are carried in louver stems 106.

As can be seen in FIGS. 2, 6 and 10-14, in the assembled blind, distal end 172 of arm 170 is in spaced relation to legs 150, 152, slot 154 and accordingly end louver 110 held in slot 154. For descriptive purposes herein, arm 170 is on the opposite side of end louver 110 from first face 180.

A fabric panel 200 (FIGS. 10-14) is looped around and thereby partly surrounds each regular vertical louver 104 in known manner. Fabric panel 200 is anchored to each regular vertical louver 104 in known manner, with male and female snap fastener provided near an upper edge 202 of fabric panel 200. The fastener components are spaced from each other and fastened to each other through holes 128 in vertical louvers 104 so that the segment of fabric between adjacent fastener components envelopes an edge and portions of each face 120, 122 of louver 104. It should be understood that other fastening arrangements can be used, including the use of female or male components on fabric panel 200 engaging complementary fastener components that are anchored in louvers 104. Still other structures and connecting systems can be used to connect fabric panel 200 to the vertical louvers 104, such as, for example, other physical connectors, complementary hook-and-loop patches and the like.

Figure 13:
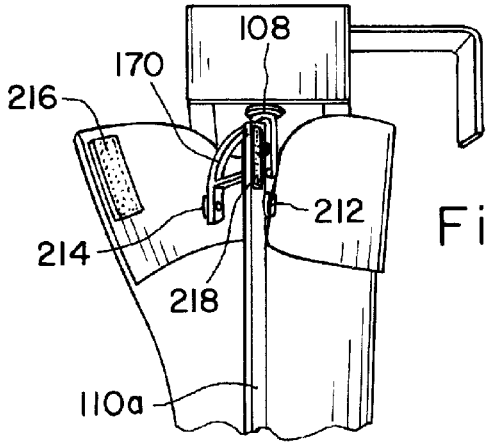
FIG. 13 shows the blind with the fabric connected to the end stem, but without the tail secured.
Figure 14:
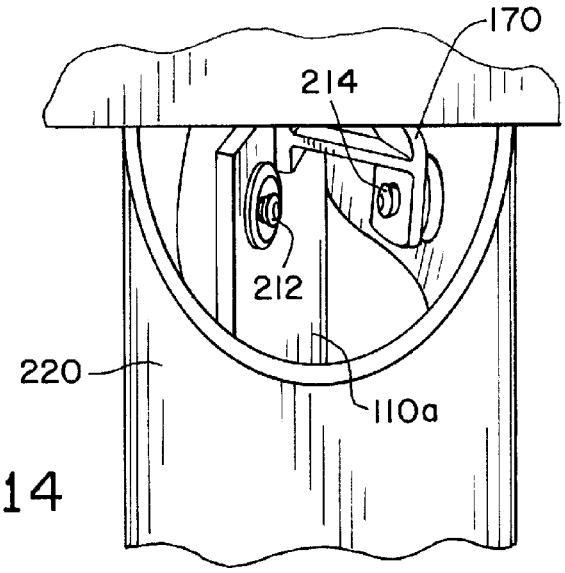
FIG. 14 is an end view of the completed blind.

The snap fastener arrangement in fabric panel 200 for the two end louvers 110 connects to the end louvers 110 and to the downwardly curved arms 170. An edge portion 210 of panel 200 includes first and second connectors 212, 214 for connecting to end louver 110 and arm 170, respectively. The end louver and arm can have appropriately sized holes for receiving male fastener components, or can include a female fastener component 204 anchored therein. Other types of fastening systems also can be used. First connector 212 is attached to end louver 110 along first face 180 thereof. Fabric panel edge portion 210 wraps around end louver 110 as shown in FIG. 13 so that second connector 214 is connected to arm 170. The outermost edge of the fabric is connected by hook-and-loop type fastening tape to an edge of end louver 110 on first face 180 thereof. Accordingly, a hook tape segment 216 is provided on either end louver 110 or fabric 200, and a loop tape 218 is provided on the other of fabric 200 and end louver 110 for connecting one to the other, to maintain the relative position of the end edge of fabric 200 to end louver 110.

Connecting fabric 200 in the manner described, with edge portion 210 connected to end louver 110 at two locations and a connection to arm 170 at a location between the two connections to end louver 110, forms a billowing column 220 of fabric suspended from curved arm 170 and end louver 110. Column 220 substantially surrounds end louver 110 and end stem 108. Accordingly, as the vertical louvers are rotated between closed and opened positions, fabric column 220 rotates, but continues to fill the outer edge of the window.

Figure 9:
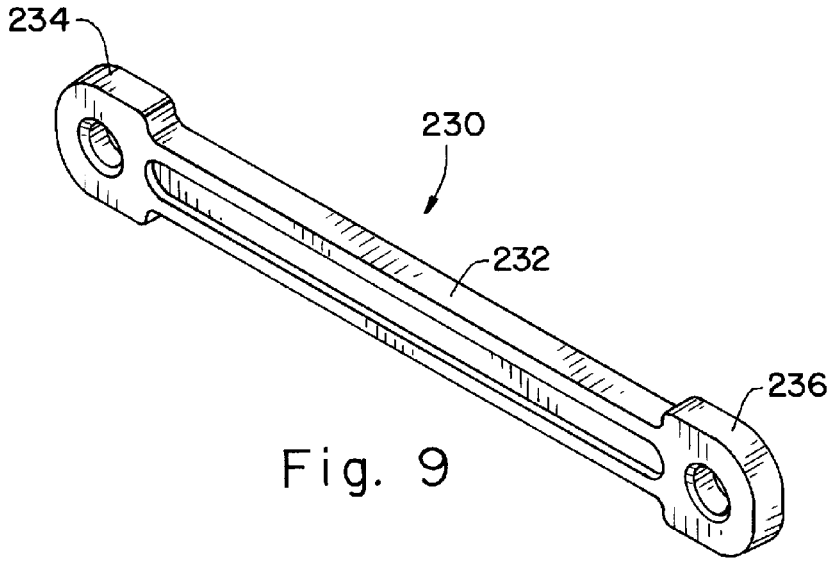
FIG. 9 is a perspective view of an end carriage spacer for the blind of the present invention.
Figure 10:
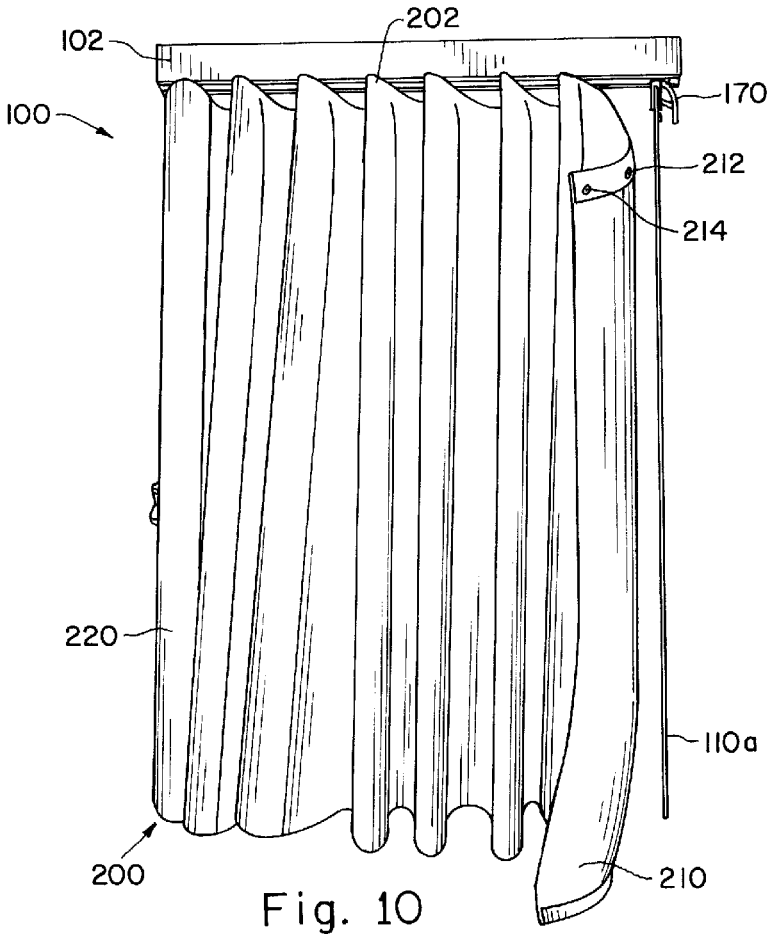
FIG. 10 shows a blind of the present invention during assembly after the fabric panel has been connected to all louvers except the last end louver.
Figure 11:
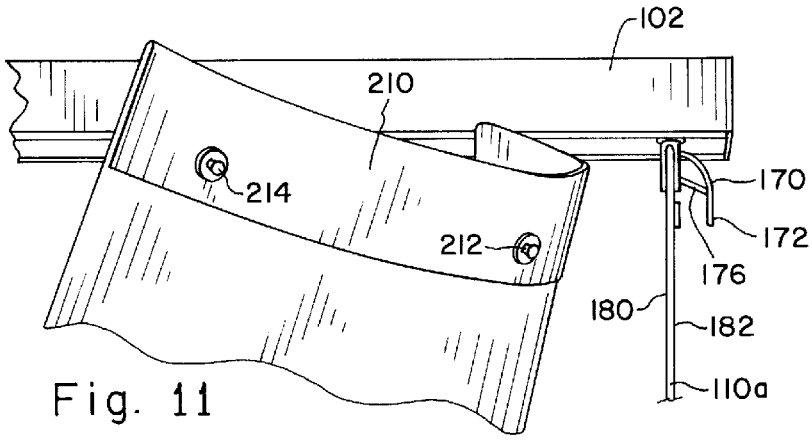
FIG. 11 is an enlarged view showing the fabric and end louver prior to connection of the fabric to the end louver and end stem.
Figure 12:
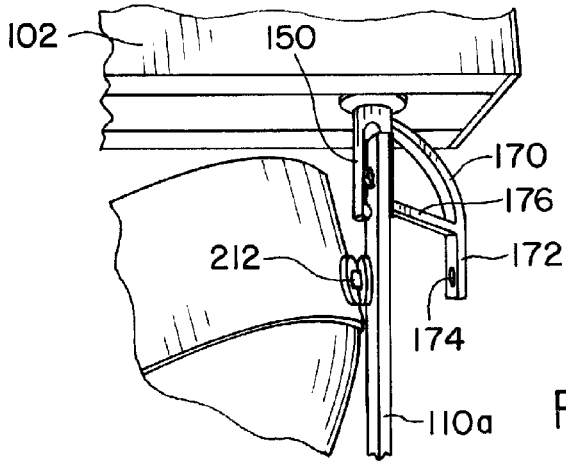
FIG. 12 shows the blind with the fabric connected to the end louver but not yet connected to the end stem.

End carriage spacers 230 are provided in the head rail (See FIGS. 6 and 9) to connect and provide proper spacing of carriages 114 carrying end stems 108 and the next inwardly adjacent regular louver stem 106. End carriage spacers 230 maintain spacing between outermost stems and the next inward stem to ensure positioning of the fabric column as the laterally most distant edge of blind 100. Each end carriage spacer has a central body 232 and connector ends 234, 236 at opposite ends of body 232.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A covering for an architectural opening, comprising:

a head rail;

a plurality of louver stems carried by and movable along said head rail;

a plurality of louvers connected to and carried by said louver stems;

a fabric panel interlaced with and connected to said louvers;

an end stem carried by said head rail, said end stem including an end louver-receiving fixture and an arm having a distal end spaced from said end louver-receiving fixture;

an end louver connected to and carried by said end stem in said end louver-receiving fixture in spaced relation to said distal end of said arm; and an edge portion of said fabric panel connected to said end louver and to said distal end of said arm in spaced relation to said end louver, said fabric forming a fabric column around said end louver.

2. The covering for an architectural opening of claim 1, said end louver having first and second faces, said fabric connected to said first face, and said arm being in spaced relation to said second face on an opposite side of said end louver from said first face.

3. The covering for an architectural opening of claim 1, said end stem disposed at a fixed distance from a next adjacent louver stem.

4. The covering for an architectural opening of claim 3, said head rail including a plurality of carriages therein, and louver stems and said end stem being held by said carriages.

5. The covering for an architectural opening of claim 4, including a spacer connecting a one of said carriages holding said end stem and another one of said carriages holding said next adjacent louver stem.

6. The covering for an architectural opening of claim 1, said end louver having a first width, and said louvers of said plurality of louvers having second width greater than said first width.

7. A covering for an architectural opening, comprising:

a head rail;

a plurality of louver stems carried by and movable along said head rail;

a plurality of louvers connected to and carried by said louver stems;

a fabric panel interlaced with and connected to said louvers;

an end stem carried by said head rail, said end stem including an end louver-receiving fixture and an arm having a distal end spaced from said end louver-receiving fixture; and an end louver connected to and carried by said end stem in spaced relation to said distal end of said arm, said end louver having first and second faces, said fabric connected to said first face, and said arm being in spaced relation to said second face on an opposite side of said end louver from said first face;

an edge portion of said fabric panel connected to said end louver and to said distal end of said arm; and said fabric have an edge portion substantially surrounding said end louver; said edge portion having first and second spaced connections to said end louver, and an intermediate connection to said arm between said first and second connections to said end louver.

8. A covering for an architectural opening, comprising:

a head rail;

a plurality of louver stems carried by and movable along said head rail;

a plurality of louvers connected to and carried by said louver stems;

a fabric panel interlaced with and connected to said louvers;

an end stem carried by said head rail, said end stem including an end louver-receiving fixture and an arm having a distal end spaced from said end louver-receiving fixture; and an end louver connected to and carried by said end stem in spaced relation to said distal end of said arm; and said fabric panel having an edge portion connected to said end louver and to said distal end of said arm, with first and second spaced connections to said end louver, and an intermediate connection to said arm between said first and second connections to said end louver.

9. The covering for an architectural opening of claim 8, said edge portion forming a fabric column substantially surrounding said end louver.

10. A blind for an architectural opening, comprising:

a head rail;

a plurality of louvers suspended from said head rail, said plurality of louvers including an end louver;

a fabric panel connected to said louvers at spaced intervals along said panel;

an edge portion of said fabric panel connected to the same side of said end louver at first and second spaced locations on said fabric panel; and said edge portion of said panel having a third connection between said first and second connections, said third connection being to a connector remote from said end louver, and said edge portion forming a column substantially encircling said end louver.

11. The blind for an architectural opening of claim 10, said louvers defining holes therein; and said fabric panel having spaced snap connector components connected through said holes.

12. The blind for an architectural opening of claim 10, said end louver spaced a substantially fixed distance from a next adjacent louver.

13. The blind for an architectural opening of claim 10, said louvers being rotatable about vertical axis thereof.

14. The blind for an architectural opening of claim 10, including an end stem retained in said head rail and holding said end louver suspended therefrom, said end stem including an arm having a distal end in spaced relation to said end louver, and said edge portion of said fabric panel being connected to said end louver and to said arm.

15. The blind for an architectural opening of claim 14, said fabric panel having an edge portion connected to said end louver at spaced first and second locations along a top edge of said fabric panel.

16. The blind for an architectural opening of claim 15, including complementary patches of a hook-and-loop connector provided on said fabric panel and said end louver.

* * * * *